United States Patent [19]

Graveline

[11] Patent Number: 4,757,779

[45] Date of Patent: Jul. 19, 1988

[54] AERODYNAMIC DEVICE WITH REVERSIBLE FLEXIBLE AND LOWERABLE CONCAVITY FOR THE PROPULSION BY THE FORCE OF THE WIND

[76] Inventor: Jean M. N. Graveline, 1 Sente des Perrottes, Eaubonne, France, 95600

[21] Appl. No.: 855,747

[22] PCT Filed: Jul. 4, 1985

[86] PCT No.: PCT/FR85/00189

§ 371 Date: Mar. 3, 1986

§ 102(e) Date: Mar. 3, 1986

[87] PCT Pub. No.: WO86/00591

PCT Pub. Date: Jan. 30, 1986

[30] Foreign Application Priority Data

Jul. 5, 1984 [FR] France ..... 84 10661

[51] Int. Cl.[4] ..... B63H 9/04

[52] U.S. Cl. ..... 114/103

[58] Field of Search ..... 114/39, 102, 103, 104; 244/219

[56] References Cited

U.S. PATENT DOCUMENTS 1,365,346 1/1921 Schenkel ..... 244/219
3,841,251 10/1974 Larson ..... 114/39
4,386,574 6/1983 Riolland ..... 114/103

FOREIGN PATENT DOCUMENTS 889560 1/1944 France ..... 114/103
1153056 5/1969 United Kingdom ..... 114/103
2119730 11/1983 United Kingdom ..... 114/103

OTHER PUBLICATIONS

Rapport de Recherche Internationale PCT/FR 85/00189 dated 19 Nov. 1985, G. L. M. Kruydenberg, Office European des Brevets, two pages.

*Primary Examiner*—Sherman D. Basinger
*Assistant Examiner*—Jesûs D. Sotelo
*Attorney, Agent, or Firm*—Holman & Stern

[57] ABSTRACT

Device for producing the concavity of a thick profiled sail and making it reversible and remotely controllable to pass through all aerodynamic profiles comprising a rotatable mast (1), at least six assemblies sliding on the mast, each comprising a leading edge profile (3) provided with an inflatable part (4), and a mechanism (2) having two flexible battens (5) arranged symmetrically on either side. The trailing edge or rear end of the battens is controlled by a system of crow feet and sheet arms (6). The device is intended particularly for the propulsion of boats.

18 Claims, 10 Drawing Sheets

AERODYNAMIC DEVICE WITH REVERSIBLE FLEXIBLE AND LOWERABLE CONCAVITY FOR THE PROPULSION BY THE FORCE OF THE WIND

CROSS REFERENCE TO RELATED APPLICATION(S)

This U.S. application stems from PCT International Application No. PCT/FR85/00189 filed July 4, 1985.

BACKGROUND OF THE INVENTION

1. Field of the Invention

The present invention relates to a device which improves the lift and decreases the drag of a sail by the provision of a thick profile instead of a simple flat surface held up by a fixed mast. Contrary to the conventional sail, this thick profile will be able to be controlled on demand and independently of the ambient wind.

2. Description of the Prior Art

Conventional simple surface sails lead to an accumulation of aerodynamic perturbations (the drag of the mast disturbing the laminar flow, important induced drag leading to a bad sharpness ratio, etc.) and, in addition, they cannot be correctly controlled for the following reasons:

1. The sail should be as flat as possible, when the wind rises; but because of the wind this sail is hollowed, so that considerable forces must be applied in order to prevent this deformation.

2. The sail should be hollowed when the wind slackens; but this soft wind has insufficient force to hollow this thin profile.

At the present time, several types of thick propulsive systems or thick sails are known as follows:

The suction effect in the cylinder designed by the Cousteau Institution which is an important improvement of the discoveries made by Mr. MALAVARD, based on the Magnus principle of the rotatable cylinder.

The thick propeller of Messrs. PHILLIPPE and COESSIN.

The rigid sail used on the oil coaster "Shin Aito Kumaru" invented in Japan.

In spite of their obvious advantages, these different discoveries have some defects, such as overweight in the high parts, complex and fragile systems requiring either a large staff or computer assistance, the absence of the hauling down facility, use of the least power possible for their carrying out their functions, and, on the other hand, they are often far from the idea of a sail which normal consumers perceive, from the points of view of aesthetics and price, but especially from the need for using cordages and other rigging, as in the conventional sail.

BRIEF SUMMARY OF THE INVENTION

The device according to the present invention eliminates these drawbacks, as well as some others. The object of the present invention is the propulsion of terrestrial or marine vehicles without any external energy except the wind, and without the drawbacks stated above.

For that purpose, the device is made up of a mast which has a circular or square cross-section, which may be guyed, which rotates in the hull of the vehicle supporting it and which may be controlled in its rotation in a precise manner.

On this mast, are slidably mounted at least six assemblies perpendicular to the axis of the mast and which are made up of a mechanism comprising a leading edge profile equipped with an inflatable part and with two battens symmetrically held by braces.

The ring, which is located within the mechanism sliding on the mast and which is driven by it in its rotation, on the right and on the left acts by traction on cables which are fastened to both battens at one of the braces.

This traction induces deformation of the battens, because the latter are also held at their trailing edge by a sheet arm system.

The whole of these two coordinated maneuvers allows the precise control of the curvature and of the incidence of these assemblies in harmony with the desired aerodynamic profiles.

BRIEF DESCRIPTION OF THE DRAWINGS

The invention will now be described in greater detail with reference to the drawings wherein.

DETAILED DESCRIPTION

The invention consists in modifying the shape of a thick aerodynamic profile, to provide that its extrados become intrados and vice versa in passing through all the profiles of the aerodynamic catalogue which has been chosen.

Referring to the appended drawing, the elements and assemblies which comprise the invention and its operation will now be described.

Each assembly for controlling the sail comprises a ring 10, 10' which slides upwardly on a rotatable mast having a circular 1 or square 1' cross-section and is driven in its rotation either by the square cross-section of the mast, or where the mast has a circular cross-section, by a rail 13 which is vertically fastened on the mast and engages in a groove 13' of the ring.

Figure 4:
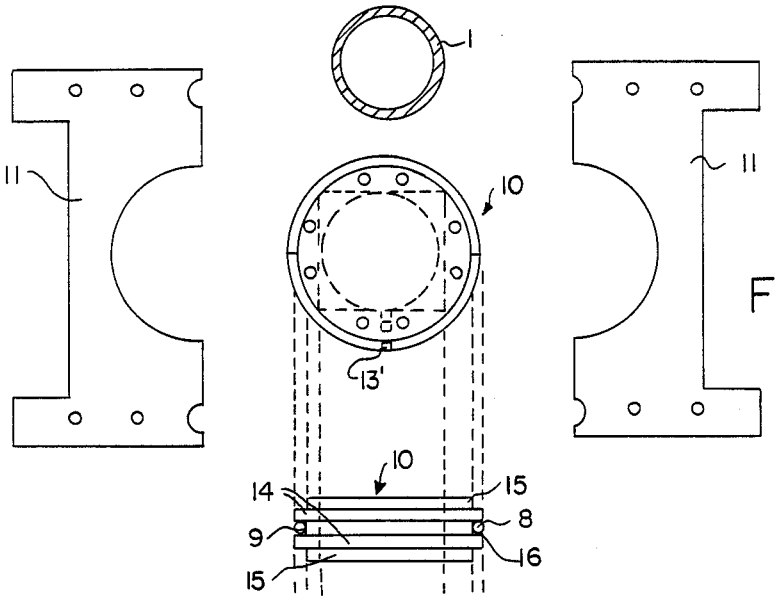
FIG. 4 is an exploded top plan view which illustrates schematically the embodiment of the mechanism with a mast and battens having circular cross-sections.
Figure 5:
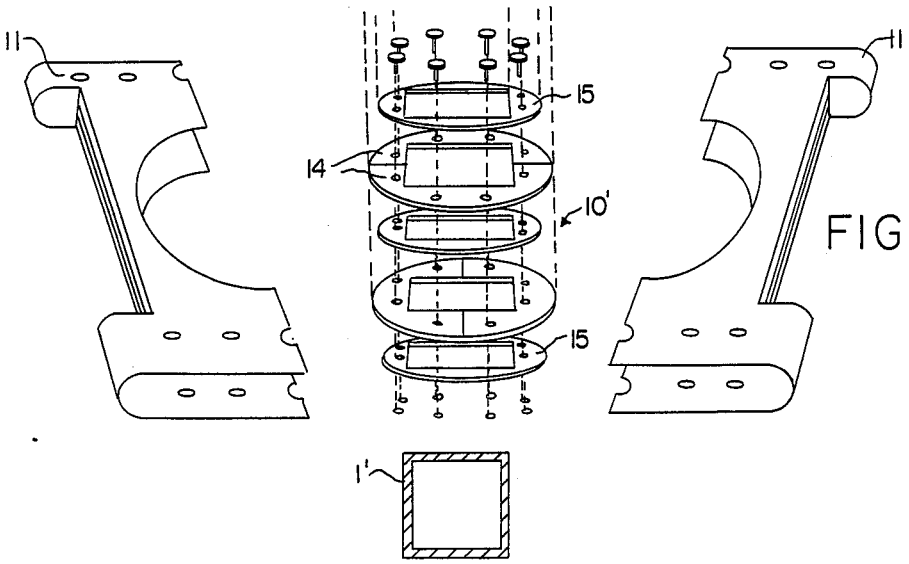
FIG. 5 is an exploded perspective view of the embodiment of parts of the mechanism for a mast having a square cross-section.
Figure 2:
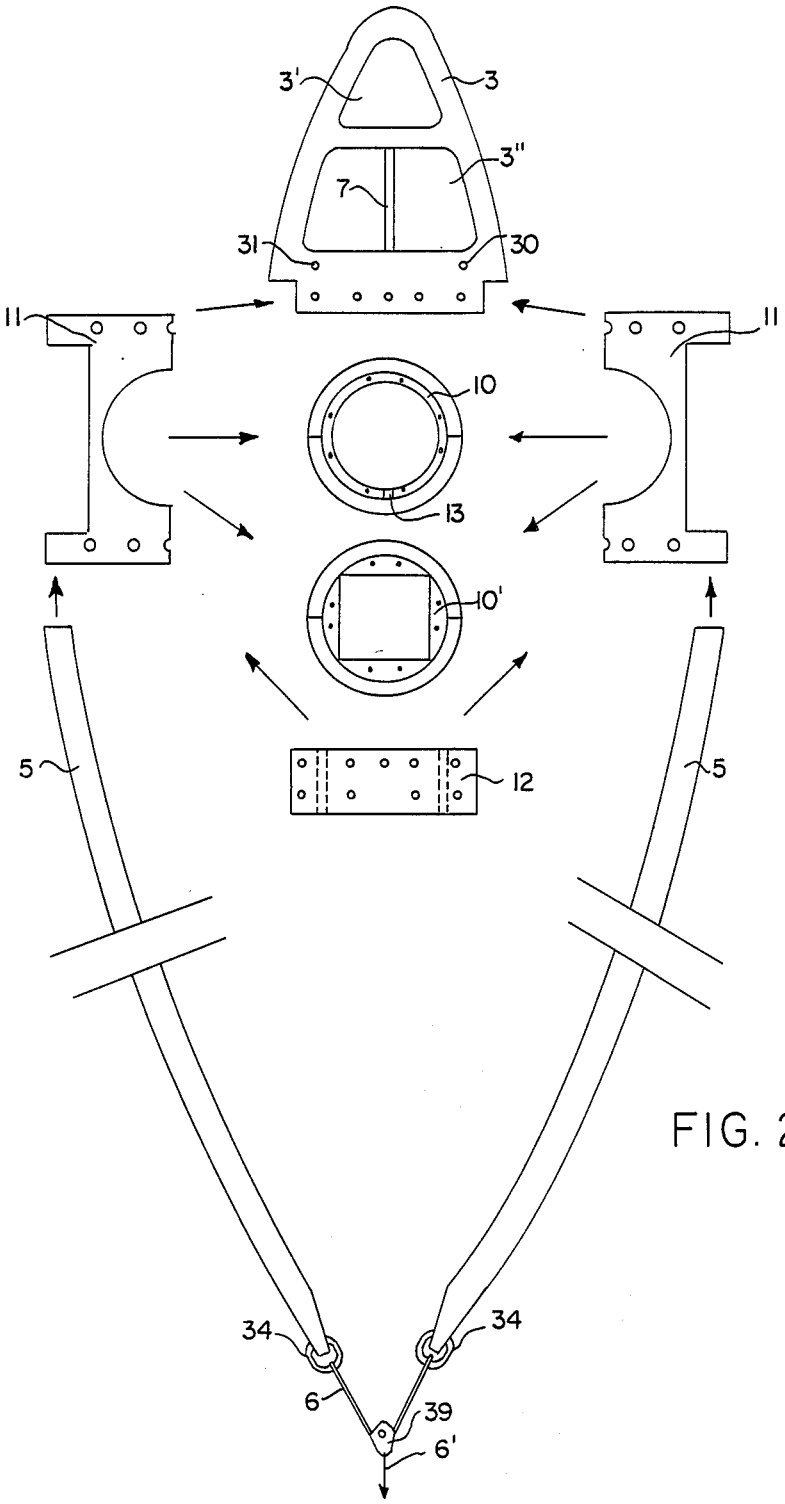
FIG. 2 is an exploded top plan view of the pieces of which the assembly of FIG. 1*a* is made.
Figure 3:
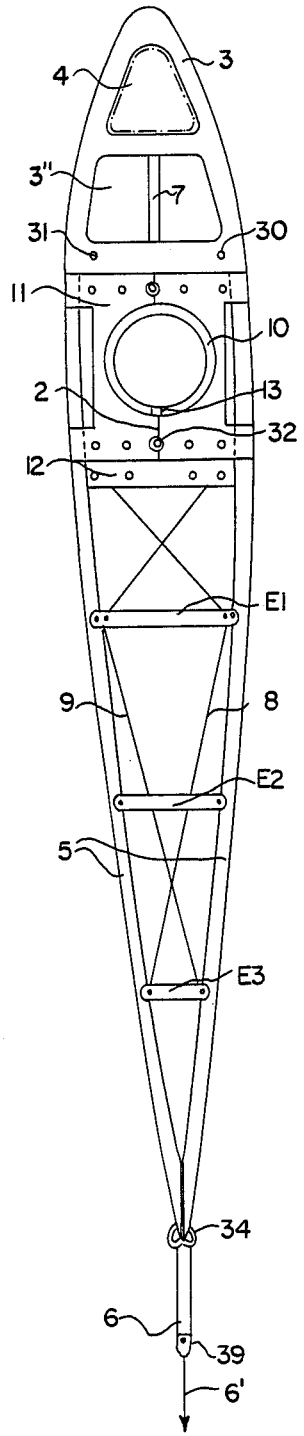
FIG. 3 is a top plan view of a complete assembly as mounted for use.
Figure 6:
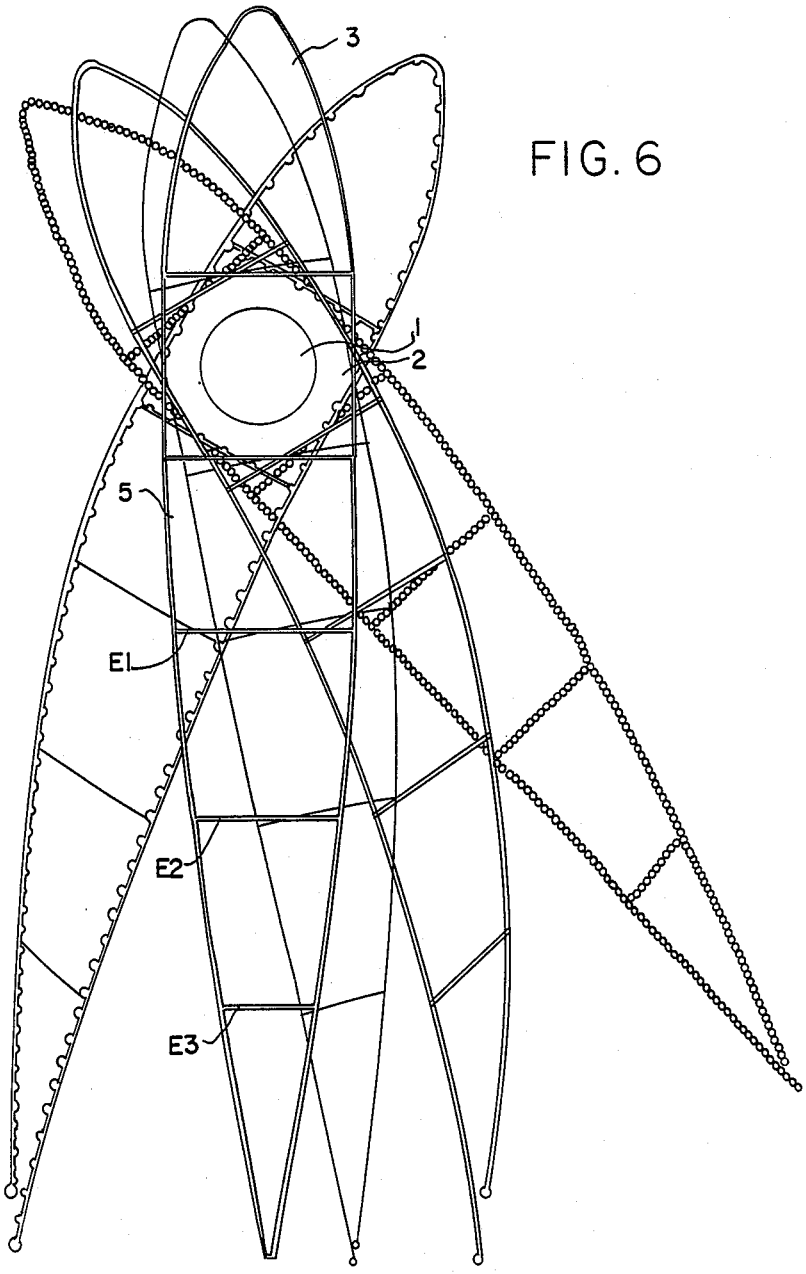
FIG. 6 is a top schematic view showing some ways for obtaining a profile with reversibility.

This ring is made in such a way that it is entirely dismountable (FIGS. 4 and 5), without having to extract it from the mast.

For that purpose, it is made of several circular half-shields 14 which fit together by overlapping with circular members 15, in order to form a homogeneous assembly. The parts 15 are in friction contact with and between members 14 and are made of a material which presents good sliding characteristics.

Ring 10, 10' also comprises a pulley groove 16 in which will be engaged and will move the cables 8, 9 for controlling the curvature of the battens by rotating the mast.

The housing of mechanism 2 is made of two identical pieces 11, or 11', rotating around the ring without touching the mast.

These two pieces 11, or 11', support two symmetrical battens 5, 5', respectively, and are fastened at their forward portions on the leading edge profile 3 and on their rear portions on the piece 12 which stiffens the mechanism and which is used for the passage of the curvature modification cables 8 and 9. Both pieces 11, or 11', are made preferably of a light and rigid material such as "AG 4" used in aeronautics.

Figure 1A:
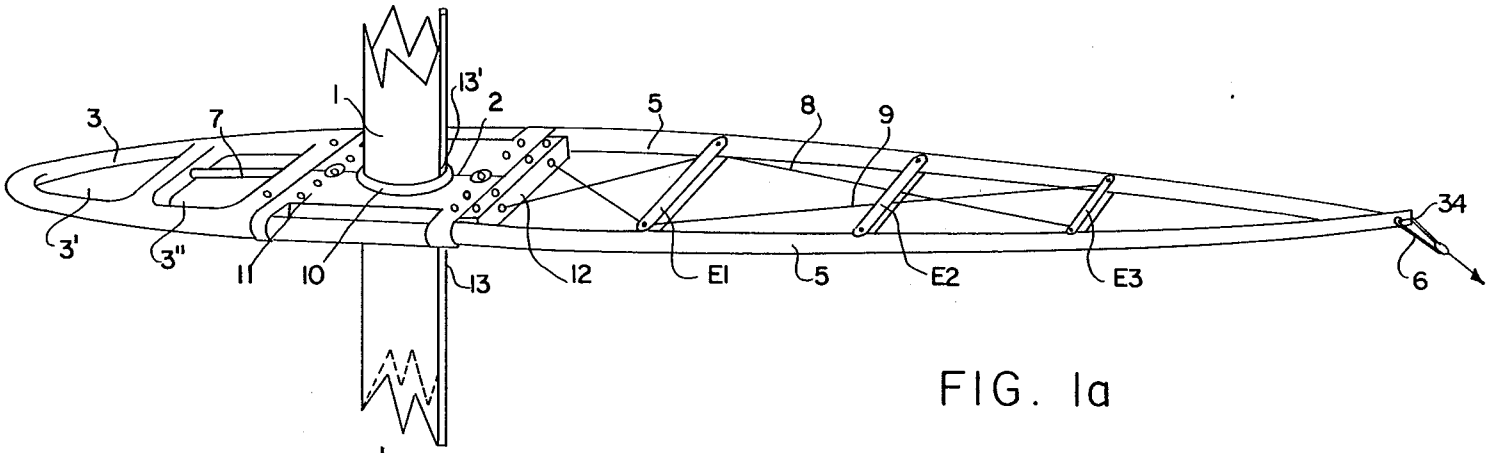
FIGS. 1*a* and 1*b* are perspective views of the assembly, mechanism, leading edge and battens in accordance with the invention, FIG. 1*b* showing a second embodiment of the shape of the battens.
Figure 1B:
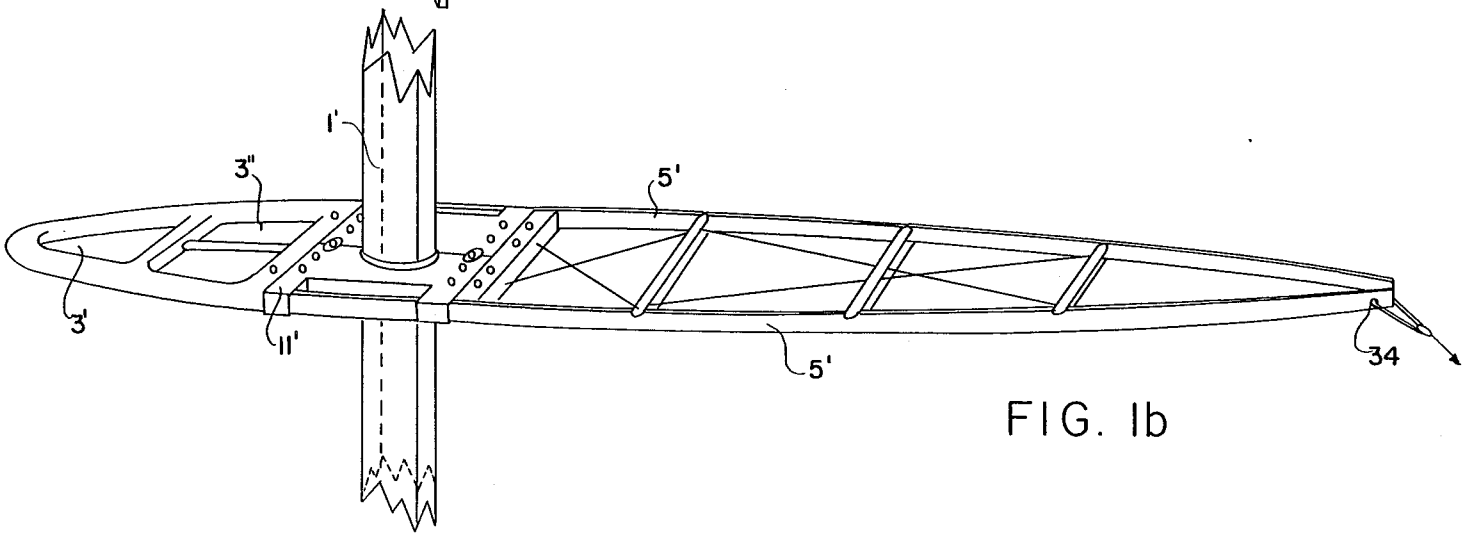

The battens 5 shown in the figures, except FIG. 1, are circular in cross-section, and the associated parts are adapted for this shape, but they may also be rectangular in cross-section if desired, as shown in FIG. 1*b*.

The leading edge profile 3 is made of wood, molded plastic or other material having lightness and strength.

Figure 8:
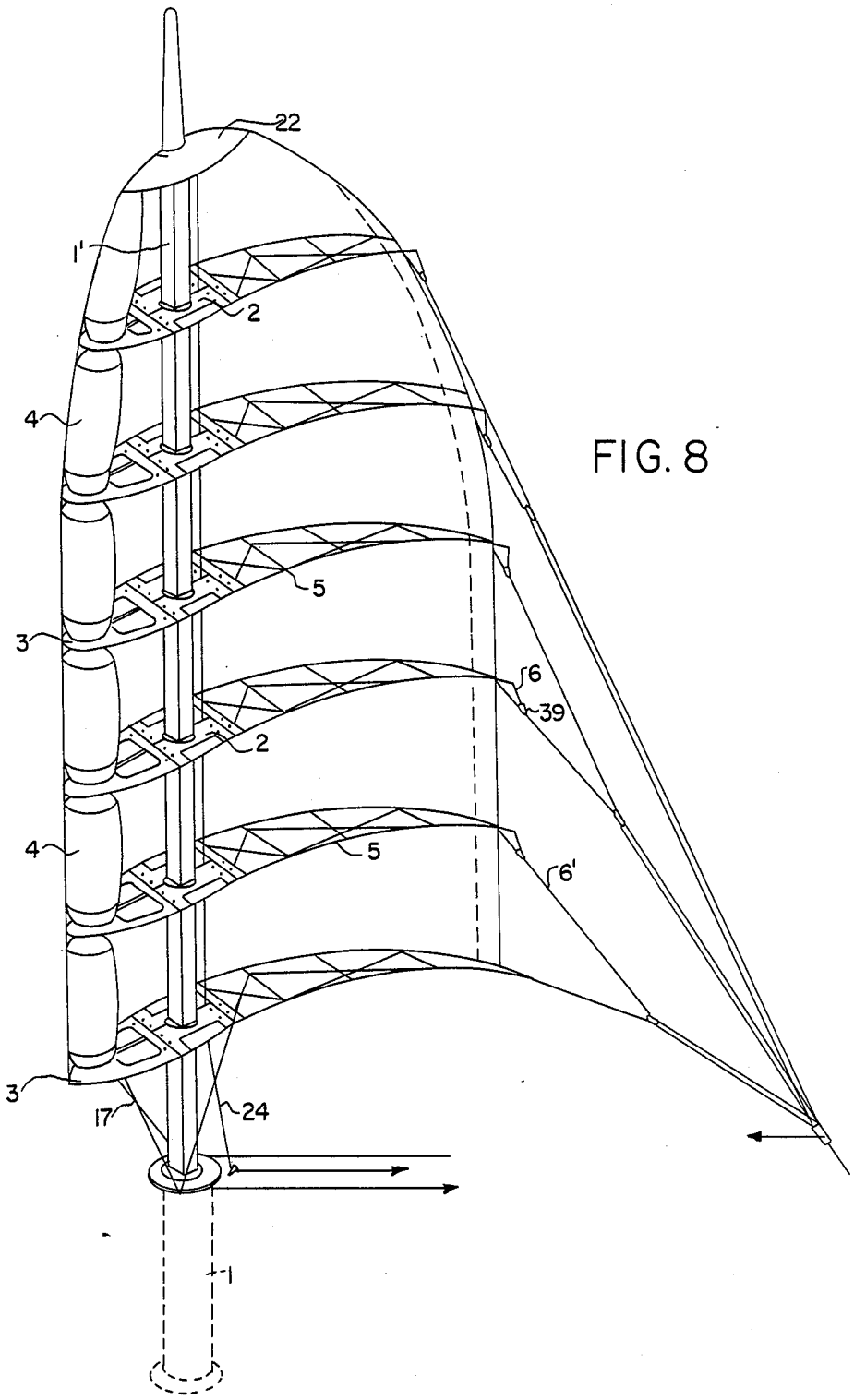
FIG. 8 is a perspective view of the complete device with the covering on the left side omitted and illustrating the internal rigging.
Figure 9:
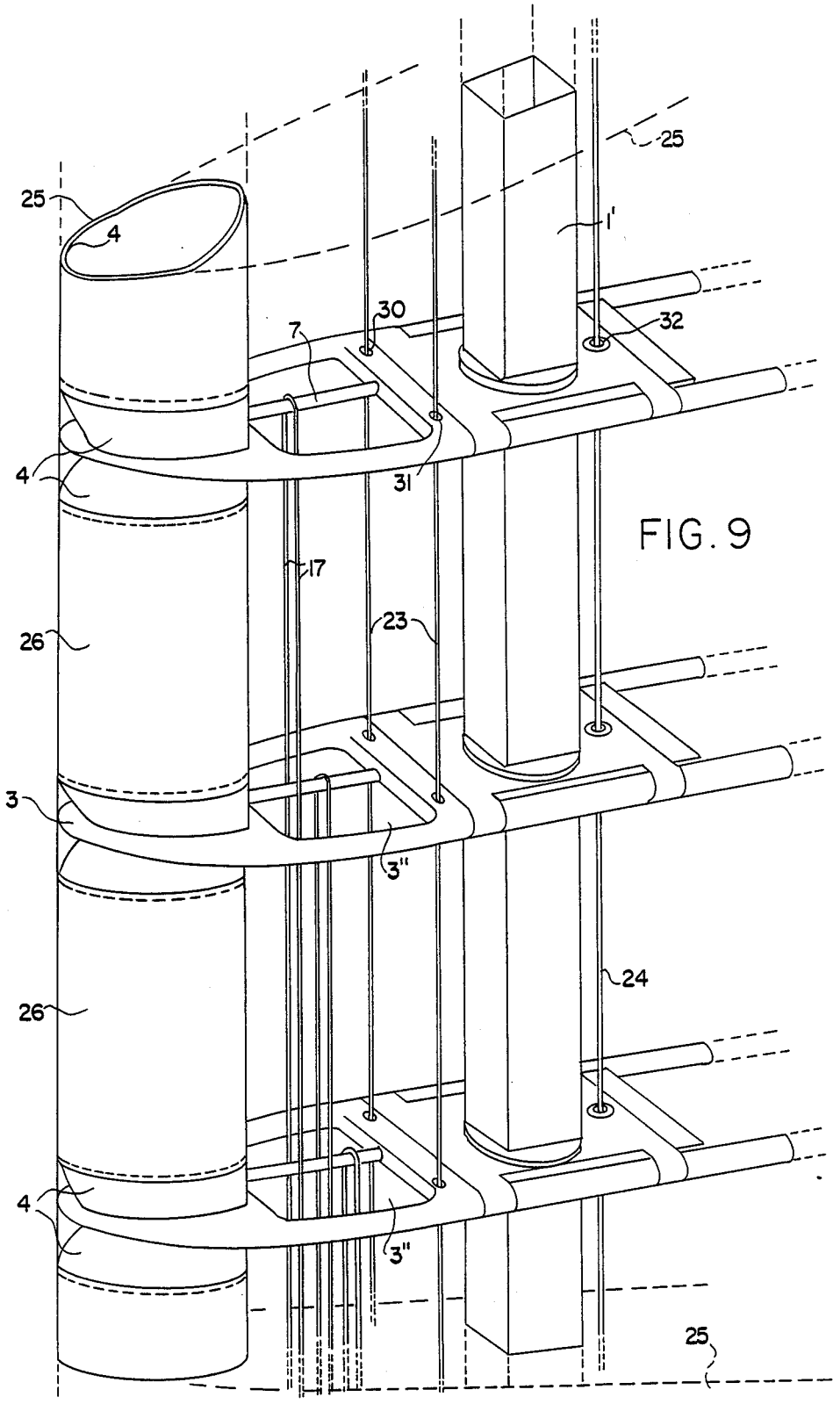
FIG. 9 is a perspective view which illustrates schematically the inflatable leading edge, the reef-taking system, and the lift system.

Leading edge profile 3 has a front recess 3' through which passes inflatable hose 4 used for stiffening the leading edge, and a central recess 3" through which passes a rotatable axle 7 over which reef-taking line 17 (FIG. 9) engages and passes downwardly at the mast heel passing through the central recesses 3" of the other lower assemblies (FIG. 8).

Member 3 is also pierced with holes such as 30, 31 (see FIG. 9) which may be provided with feed-through sleeves (not shown) for avoiding wear due to friction of the lift lines 23 (FIG. 9) and with four holes for the screws for fastening to the mechanism housing.

The piece 12 stiffening the back part of the mechanism benefits by being made of Nylon or similar material, which avoids wear of the two cables 8 and 9 which pass through it in the horizontal direction, and the wear by friction of the halyard 24 in hole 32. Four paths for the screws for fastening to the mechanism housing are also provided.

The flexible battens 5 may have a circular, or rectangular 5', cross-section as stated above and are made of glass fiber, epoxy resin, carbon or bamboo for the circular cross-section, and hardened Dural or bonded laminated wood or similar material for the rectangular cross-section. Their rearward parts up to the brace E1 will benefit by being reinforced in order to minimize the intrados deformation in this part and to assist at best all the different curvatures of the chosen aerodynamic profiles by at least three spacer braces E1, E2, E3, the ends of which are linked to the battens. An anchorage of transmission of curvature cables 8 and 9 is provided at the level of the links of the brace E3 nearest the trailing edge, and, finally, at the end of this same edge, two rings 34 made of stainless steel each passing through one of the two battens and joined together by the ends of a sheet cordage 6 so that they can move relatively to one another, cordage 6 being connected to the sheet 6' through pulley 39.

Figure 7:
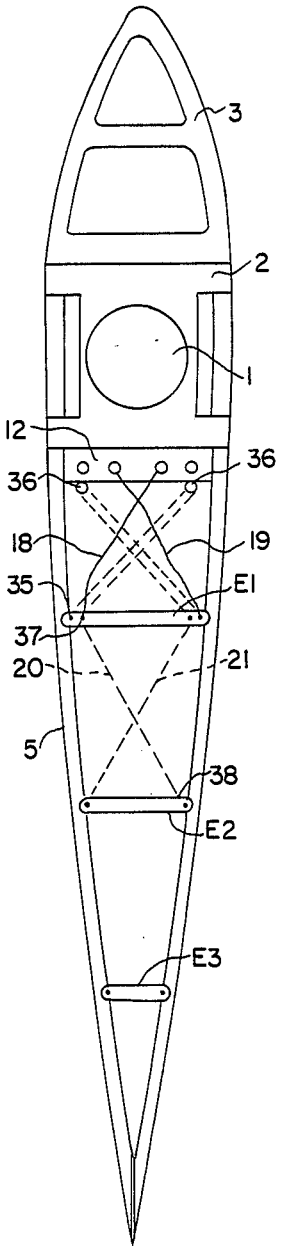
FIG. 7 is a top plan schematic view of two systems for controlling the deformation of the profile.

Two systems for controlling the deformations of the battens are shown in FIG. 7. Both flexible cables 18 and 19 are used for limiting, when they are in a stretched state, the deformations of the intrados at the level of the brace E1. For that purpose, they are fastened respectively on a side of piece 12 and on the link of the brace E1 on the other side (and inversely for the second one), sufficient clearance being provided so that there is a minimal deformation corresponding at best to the curvature of the chosen aerodynamic profile. Both cables 20 and 21 are used for stiffening the profile whatever its curvature, in order to prevent the deformation of the extrados at the level of brace E1. The first end 35 of each of these flexible cables 20 and 21 is attached on a side of the link of the brace E1 and then passes through a pulley 36 attached to the piece 12, and returns to the same side of the brace E1, to lead around another pulley (not shown) on brace E1 at 37 and is fastened at the other end, on the other side, on the link of the brace E2 at 38 (and inversely for the other cable).

The inflatable leading edge 4 attached under the head 22 (FIG. 8) as well as to the assembly located in the lowest position, pass through a duct 26 (FIG. 9) of the covering between each assembly and through the front recesses 3' of the leading edge profile 3. It may be inflated by means of two valves, one being located topside and the other below, where it is attached to either a hand pump which injects air, or to any other means which injects an adequate gas. The valves are connected by a waterproof tube either at the mast heel or at any other useful location.

Figure 10A:
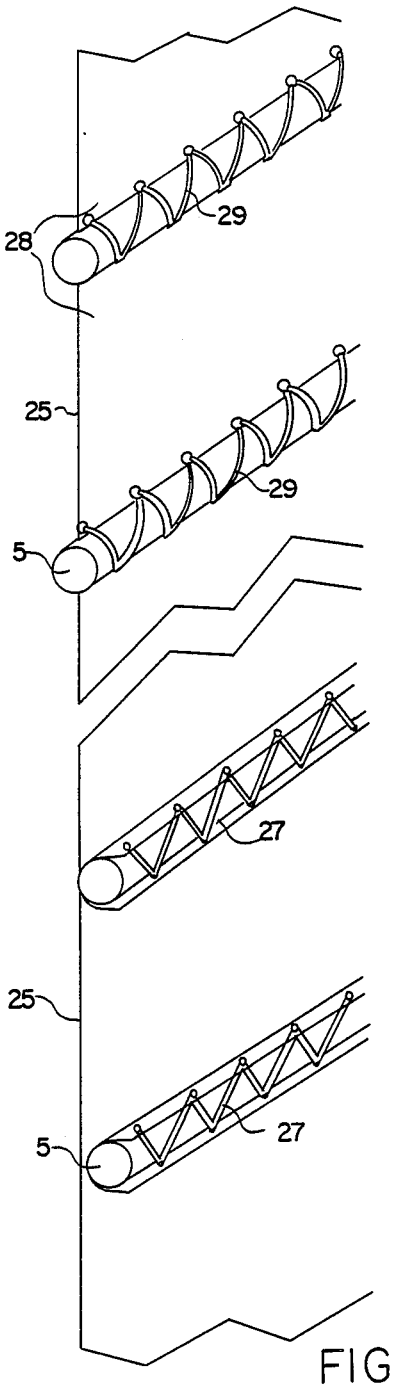
FIGS. 10*a* and 10*b* are perspective views of different embodiments of the covering of both sides of the sail and their connecting system.
Figure 10B:
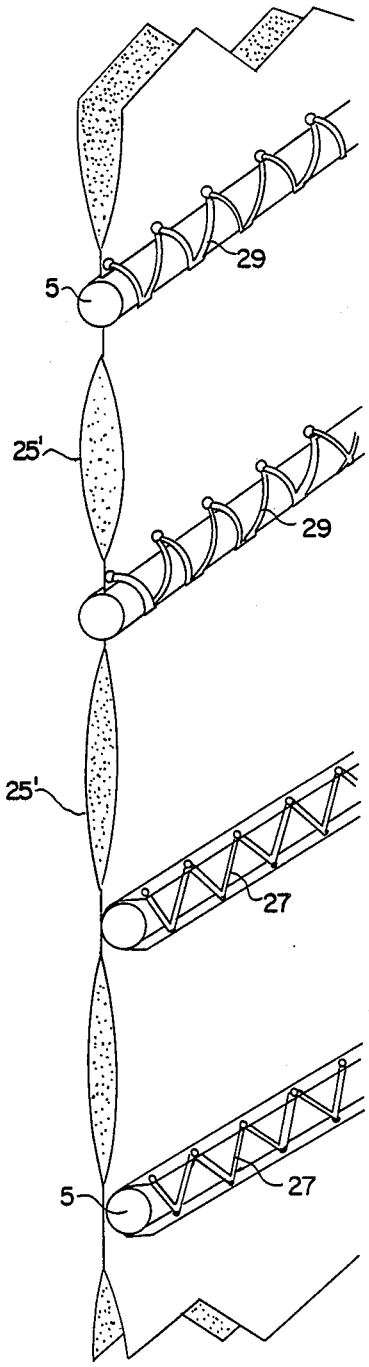

Two possible covering arrangements are shown in perspective and cross-sectional view in FIGS. 10*a* and 10*b* wherein this covering extends around the six aerodynamic assemblies and the head, in order to form the leading edge and both faces of the sail profile which may independently represent the extrados or the intrados of this device. In a first embodiment, it is a conventional canvas covering 25 bound on the assemblies according to the two methods indicated, i.e. either by the internal binding 27 of a covering running from the bottom to the top of the profile, or by independent cloth pieces 28 bound at their lower and upper edges by turns 29. In the second embodiment, it is a covering which is comprised of two waterproof envelopes 25' which may be inflated and attached in the same manner as in the first embodiment. This inflating which stiffens the surface of the profile between each assembly, is used, as is the inflatable leading edge, as a safety feature to prevent capsizing or turning upside down in the case of a maritime use on a boat.

Figure 11:
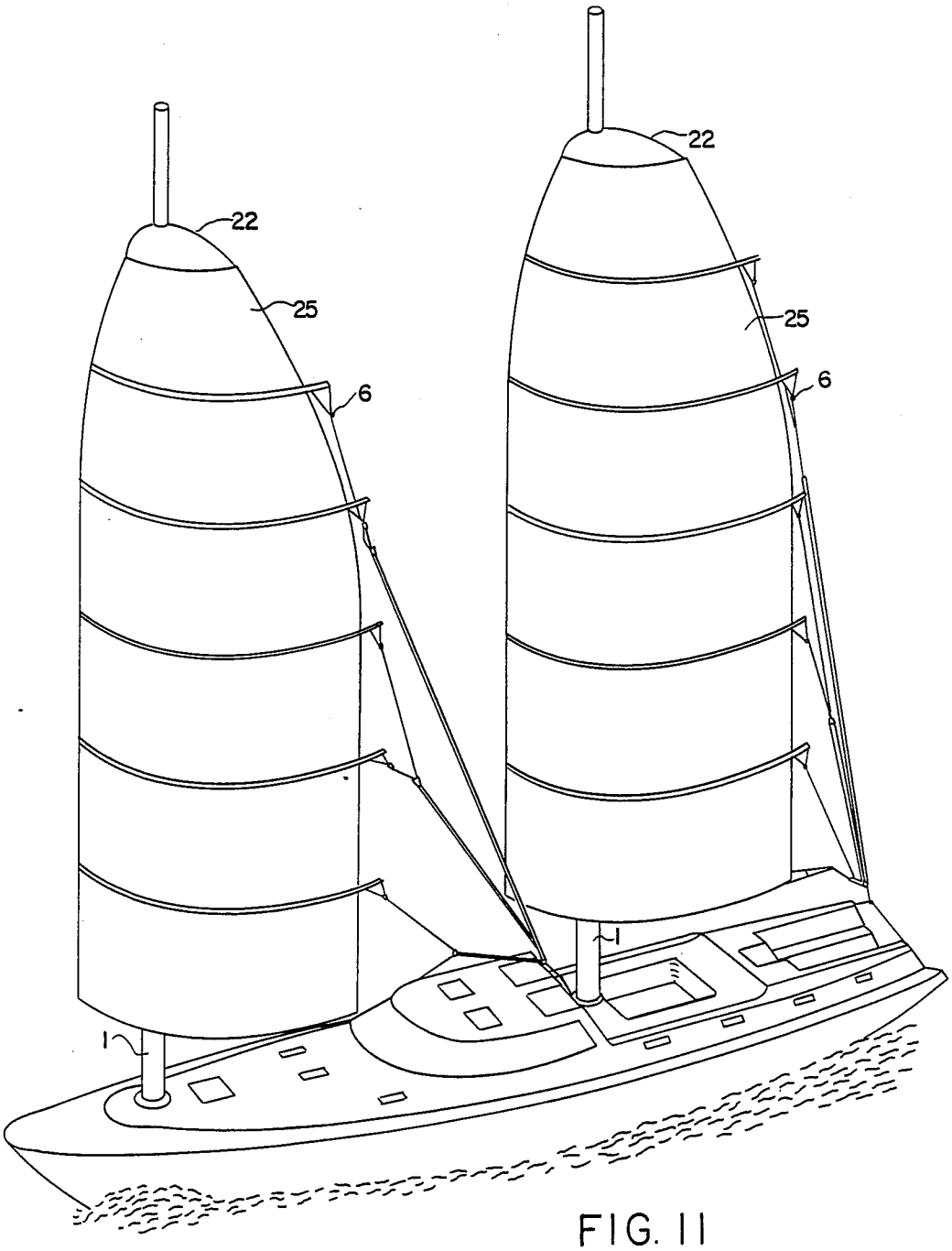
FIG. 11 is a perspective view which illustrates schematically the installation of two devices according to the present invention on a single-hull sailing-boat.

In order to illustrate an application of the device according to the invention, FIG. 11 shows a sailing boat equipped with two devices according to the invention.

It is also possible and it may be contemplated to use this device for power generation by its adaptation as a multiple-blade of a wind power wheel, which drives a generator or any other mechanism.

Other alternate embodiments both in shapes and in materials used may be contemplated; the invention is not limited by the description of particular embodiments in the preceding paragraphs.

The above defined device will give from twice and a half to thrice as much power of a conventional thin sail. Consequently, it will be possible, for equal power, to reduce their area and to obtain a much lower cost.

The use of such a device obviates the requirements for the large forces and equipment which are nowadays employed (tackles, winches, rails, rigging devices, etc.), because the part of the device protruding ahead of the mast acts as a compensating means for the stresses applied by the wind to the rear of the mast.

The multiple sheets of the sail system as described reduce high stresses in a single sheet and due to the inflatable parts, the device described has a very important safety feature for sailing since the inflatable parts resist capsizing.

For all the reasons which have been set forth hereinbefore, both in the construction part and in the working part, and also due to its efficiency, the invention offers a certain interest for everybody, and for the adaptation to any future sailing boat for improving its performance.

I claim:

1. A sail device comprising:
a rotatable mast;
a plurality of profiled sail supporting assemblies slidably supported on said mast substantially perpendicular thereto, each sail supporting assembly comprising,
a ring member slidably mounted on and rotatable with said mast,
at least two flexible battens supported on said ring member in spaced relationship with respect to each other, said battens each having a free trailing edge,
sheet means attached to said trailing edges so that said trailing edges are movable with respect to each other,
a plurality of braces spaced longitudinally along and connecting said battens together, and
means for linking said battens with said ring member so that rotation of said mast deflects said battens to form substantially concave and convex profiles on opposite sides of said assembly and the degree of rotation of said mast controls the amount of deflection of said battens; and
a covering on said plurality of said supporting assemblies forming a sail surface conforming to said profiles.

2. A sail device as claimed in claim 1 wherein said linking means comprises cables.

3. A sail device as claimed in claim 2 wherein said ring member comprises:
substantially semi-circular shaped elements removably engageable in an assembled position around said mast; and
means to retain said elements together when in the assembled position.

4. A sail device as claimed in claim 3 wherein
said ring member comprises a plurality of said substantially semi-circular shaped elements superposed on each other and having relative sizes to form a pulley groove on said ring member; and
said cables engage in said groove and link said ring member to said braces.

5. A sail device as claimed in claim 2 wherein:
said battens are supported on said ring member by two cooperating batten support members each removably attachable to said ring member to rotate therewith and partially surrounding said mast when assembled and attached to said ring member.

6. A sail device as claimed in claim 5 wherein each sail supporting assembly further comprises:
a leading edge profiled member removably attachable to said batten support members on the side of said mast substantially opposite to that of said trailing edge, said covering also extending over said leading edge members.

7. A sail device as claimed in claim 6 and further comprising:
a first opening in the forward portion of each leading edge profiled member; and
an inflatable tubular member extending through each first opening.

8. A sail device as claimed in claim 7 and further comprising:
a second opening in said leading edge profiled member; and
a rotatable axle rotatably mounted on said leading edge profiled member and extending across said second opening for engagement with a reefing line.

9. A sail device as claimed in claim 2 wherein said sheet means comprises:
a cordage connected at its ends to said trailing edges; and
a sheet connected to said cordage at a traction point.

10. A sail device as claimed in claim 9 wherein said ring member comprises:
substantially semi-circular shaped elements removably engageable in an assembled position around said mast; and
means to retain said elements together when in the assembled position.

11. A sail device as claimed in claim 10 wherein
said battens are supported on said ring member by two cooperating batten support members each removably attachable to said ring member to rotate therewith and partially surrounding said mast when assembled and attached to said ring member.

12. A sail device as claimed in claim 11 wherein each sail supporting assembly further comprises:
a leading edge profiled member removably attachable to said batten support members on the side of said mast substantially opposite to that of said trailing edge, said covering also extending over said leading edge members.

13. A sail device as claimed in claim 12 and further comprising:
a first opening in the forward portion of each leading edge profiled member; and
an inflatable tubular member extending through each first opening.

14. A sail device as claimed in claim 13 and further comprising:
a second opening in said leading edge profiled member; and
a rotatable axle rotatably mounted on said leading edge profiled member and extending across said second opening for engagement with a reefing line.

15. A sail device as claimed in claim 14 wherein:
said ring member comprises a plurality of said substantially semi-circular shaped elements superposed on each other and having relative sizes to form a pulley groove on said ring member; and
said cables engage in said groove and link said ring member to said braces.

16. A sail device as claimed in claim 15 wherein
said mast has a circular cross-section;
a longitudinal rail is mounted on said mast;
said ring member has a circular hole therethrough for rotatably receiving said mast; and
a groove is provided in said ring member for sliding engagement with said rail and preventing relative rotation between said ring member and said mast.

17. A sail device as claimed in claim 1 wherein said sheet means comprises:

a cordage connected at its ends to said trailing edges; and a sheet connected to said cordage at a traction point.

18. A sail device as claimed in claim 1 wherein:

said mast has a circular cross-section;

a longitudinal rail is mounted on said mast;

said ring member has a circular hole therethrough for rotatably receiving said mast; and a groove is provided in said ring member for sliding engagement with said rail and preventing relative rotation between said ring member and said mast.

* * * * *